United States Patent [19]

Mizuma

[11] 4,426,073

[45] Jan. 17, 1984

[54] APPARATUS FOR ALIGNING A PAPER SHEET WITH A REFERENCE LINE

[75] Inventor: Kenichi Mizuma, Kawasaki, Japan

[73] Assignee: Ricoh Company, Ltd., Japan

[21] Appl. No.: 233,771

[22] Filed: Feb. 12, 1981

[30] Foreign Application Priority Data

Feb. 27, 1980 [JP] Japan ..... 55-22843

[51] Int. Cl.[3] ..... B65H 9/16

[52] U.S. Cl. ..... 271/251

[58] Field of Search ..... 271/248, 250, 251, 225, 271/240

[56] References Cited

U.S. PATENT DOCUMENTS

| | | | |
|---|---|---|---|
| 2,154,825 | 4/1939 | Smith | 271/251 X |
| 2,240,424 | 4/1941 | Spiess | 271/251 |
| 2,302,067 | 11/1942 | Spiess | 271/251 |
| 3,709,596 | 1/1973 | Ulmer | 271/251 X |
| 3,980,296 | 9/1976 | Craft | 271/251 |
| 4,162,786 | 7/1979 | Bullock | 271/251 X |

OTHER PUBLICATIONS

IBM Technical Disclosure Bulletin, vol. 22, No. 6, pp. 2496, 2497, Nov. 1979, Paper Feed Mechanism, J. S. Heath.

*Primary Examiner*—Richard A. Schacher

*Attorney, Agent, or Firm*—Guy W. Shoup; Eliot S. Gerber

[57] ABSTRACT

A sheet paper transporting and aligning apparatus is provided with a sideline reference wall for aligning one side edge of a paper sheet before transporting it to a desired position. The apparatus is further provided with rollers which bring the paper sheet in contact with the reference wall. The apparatus is characterized by conveying the paper sheet in the direction away from the reference wall with a predetermined angle prior to engagement between the paper sheet and the rollers. This insures faultless paper sheet aligning operation and prevents occurrence of paper jamming.

8 Claims, 6 Drawing Figures

APPARATUS FOR ALIGNING A PAPER SHEET WITH A REFERENCE LINE

BACKGROUND OF THE INVENTION

1. Field of the Invention

The present invention relates to a sheet paper transporting and aligning apparatus which receives a paper sheet and align it with a reference line before delivering it to a desired location. More in particular, the present invention is concerned with a copy paper aligning apparatus for use in copying machines and the like, which receives a copy paper as fed from the copy paper supply station and transport it to a transfer station, where a toner image is transferred onto the copy paper, after aligning one side edge of the copy paper with a reference line.

2. Description of the Prior Art

It is often desired to transport paper sheets or documents from one station to another. For example, in a transfer type copy machine, a quantity of copy papers are stored at a copy paper supply station and copy papers are removed one by one to be transported to a transfer station where developed or toner images formed on a photosensitive drum are transferred onto the copy paper. However, in order to carry out a proper image transfer operation, two requirements must be met. One of the requirements is the synchronism between the rotation of the photosensitive drum and the transport of a copy paper. That is, a copy paper must be transported to the transfer station with a proper timing so that the leading and trailing edges of the copy paper may properly match the front and rear boundaries of the image area on the peripheral surface of the photosensitive drum. A common practice to cope with this problem is to use a register roller, which is usually disposed in the copy paper travelling path and in front of the transfer station. The register roller is driven to rotate intermittently in synchronism with the rotation of the photosensitive drum and, therefore, the use of such a register roller enables to obtain matching between the leading and trailing edges of the copy paper and the front and rear boundaries of the image area. It should, however, be noted that such a register roller does not insure the sidewise alignment between the copy paper and the image area.

Therefore, the other requirement for proper image transfer is to align one side edge of the copy paper with a reference sideline before being brought into contact with the image area of the photosensitive drum. This sideline alignment is also important in correcting the orientation of the copy paper since the copy paper might be positioned somewhat aslantly with respect to the centerline of the copy paper travelling path. There are several prior art approaches to meet with this second requirement.

U.S. Pat. No. 3,980,296 issued on Sept. 14, 1976 to Craft et al. discloses an idea which may be applicable to meet such a requirement. That is, although this patent is not specifically directed to the sideline alignment of the copy paper before being fed to a register roller, it discloses a similar idea of copy paper alignment. This patent is purported to enhance the convenience of copying machines by insuring that all copy papers handled by the machine have a reference edge close to the operator. In order to attain this objective, it is proposed to provide an aligner 55 having several rollers 62,63,73 and 75 as best shown in FIG. 2 of this patent. However, it is to be noted that the copy paper 30 will be rotated around rollers 62 and 63 as soon as the roller 73 comes into engagement with the copy paper 30. As a result, one corner of the leading edge of the copy paper will move along the dotted line 65 and hit the front reference edge 46. This is not advantageous especially for thin or soft copy papers because the corner will be bent and it could be a cause of paper jamming. It should also be noted that the use of such a plurality of rollers will require fine adjustments, which necessarily complicates the structure, resulting in frequent occurrence of malfunctioning.

Another conventional approach for the sideline alignment is shown in FIGS. 1 through 3. The copy paper transport and aligning apparatus 100 generally comprises a pinch roller 3, a curved portion 4, a straight portion 7, a sideline reference wall 5 attached to the curved portion 4 and the straight portion 7, and inclined rollers 6. Thus, the copy papers stacked in a copy paper supply station are removed one by one by the action of pick-up rollers 2 and delivered to the pinch roller 3, which forms an inlet to the apparatus 100. The copy paper 12 then moves downward and slides along the curved portion 4. It is preferable to provide a discharging device 11 to eliminate possible charges on the copy paper 12 thereby preventing the copy paper 12 from being electrostatically stuck to the curved portion 4 or the straight portion 7. Then the copy paper 12 comes into contact with the inclined rollers 6 and the copy paper 12 is moved toward the sideline reference wall 5 due to the inclined arrangement of these rollers 6. As best shown in FIG. 2, the rollers 6 are arranged such that their axis of rotation is inclined over the angle, $\theta$, with respect to the line normal to the center line of the copy paper travelling path. Therefore, if the copy paper 12 is fed into the transport and aligning apparatus 100 with its edge in contact with the supply reference line 1*a* of the copy paper supply station 1 as shown in FIG. 2, the copy paper 12 will be moved over the distance a to abut against the sideline reference wall 5. Since the wall 5 presents a flat surface for contact with one edge of the copy paper 12, the orientation of the copy paper 12 is also adjusted. This completes the alignment procedure since the location of the reference wall 5 is previously determined with respect to the side boundary 10*a* of the image area defined on the photosensitive drum 10.

The register roller 8 has an idler roller and it is driven to rotate intermittently in response to the rotation of the drum 10. Thus, when the leading edge of the copy paper 12 comes into contact with the register roller 8 which is not in rotation, the advancement of the copy paper 12 is halted. On the other hand, the inclined rollers 6 are usually driven to rotate continuously. Such being the case, the inclined rollers 6 must be so arranged that they lightly touch the surface of the copy paper 12. In other words, the rollers 6 must impart a force on the copy paper 12 strong enough to move it toward the sideline reference wall 5, but the force must be weak enough for the rollers 6 to slip on the surface of the copy paper 12 while its advancement motion is restrained by engagement with the register roller 8. When the register roller 8 initiates its rotation, the copy paper 12 is advanced toward the transfer station 9 where the toner image formed on the photosensitive drum 10 is transferred onto the copy paper 12.

The distance $L_1$ between the pinch roller 3 and the inclined rollers 6 and the distance $L_2$ between the inclined rollers 6 and the register roller 8, both measured along the copy paper travelling path, should be shorter than the length between the leading and trailing edges of the smallest copy paper used, e.g., B5 size in FIG. 2. Furthermore, the total distance, $L_1+L_2$, should be set to the sum of the length between the leading and trailing edges of the largest copy paper used and the distance which is necessary and sufficient for the largest copy paper to be aligned with the sideline reference by means of the inclined rollers after its trailing edge leaving the pinch roller 3.

As shown in FIG. 2, the supply reference line 1*a* is usually defined at the distance a inside of the sideline reference wall 5. This is because the copy paper 12 might change its orientation during advancement along the travelling path due to unexpected vibrations or the like, and, even if it happens, this arrangement can allow the copy paper to stay within the limits of the travelling path, thereby avoiding the occurrence of jamming.

However, this prior art technique still suffers from disadvantages. For example, if the copy paper 12 is oriented as shown by the one-dot line in FIG. 3 immediately before the inclined rollers 6, the corner 12*a* of the copy paper 12 will first hit the sideline reference wall 5 as shown by the two-dot line. The frictional force working between the wall 5 and the corner 12*a* tends to bend the corner 12*a* and, more in severe cases, the copy paper 12 is jammed. This is more true for thinner or softer copy papers.

SUMMARY OF THE INVENTION

It is therefore an object of the present invention to provide a sheet paper transporting and aligning apparatus which enables to align the sheet paper smoothly and faultlessly.

It is another object of the present invention to provide a sheet paper transporting and aligning apparatus which is simple in structure and easy to manufacture.

It is a further object of the present invention to provide a copy paper transporting and aligning apparatus for use in a copying machine, which requires no additional moving parts such as rollers, indicating energy saving principles and elimination of elaborate adjustments as well as arrangement.

Other objects, advantages and novel features of the present invention will become apparent from the following detailed description of the invention when considered in conjunction with the accompanying drawings.

DESCRIPTION OF THE PREFERRED EMBODIMENTS

Figure 4:
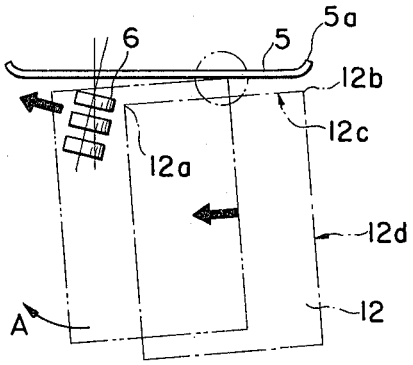
FIG. 4 is a schematic illustration showing how the copy paper is brought into contact with the sideline reference wall in accordance with the present invention.

Referring now to FIG. 4, there is shown the principle of the present invention. That is, in accordance with the present invention, it is always insured that the copy paper 12, when located immediately before the inclined rollers 6 as shown by the one-dot line in FIG. 4, is so oriented that the side edge 12*c* and the sideline reference wall 5 form a divergent angle toward the advancing direction of the copy paper 12. In other words, the corner 12*a* is located far from the wall 5 as compared with the corner 12*b* of the trailing edge 12*d*. Such being the case, when the copy paper 12 is moved toward the wall 5 by means of the inclined rollers 6, it is the corner 12*b* that hits the wall 5 first. Thereafter, the copy paper 12 is rotated as shown by the arrow A in FIG. 4 to bring the side edge 12*c* in abutment against the wall 5, thereby achieving the desired sidewise alignment.

Figure 3:
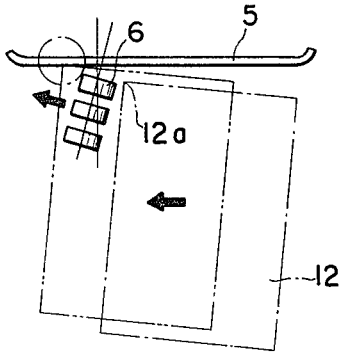
FIG. 3 PRIOR ART
FIG. 3 is a schematic illustration showing the possible occurrence of paper jamming in the conventional apparatus shown in FIGS. 1 and 2.

If the structure of FIG. 4 is compared with that of FIG. 3, it should be easily understood that the present invention is advantageous over the prior art apparatus. In the prior art device as shown in FIG. 3, the frictional force of reaction at the corner 12*a* works toward the copy paper 12, indicating increased tendency to bend the corner 12*a*; whereas, in accordance with the present invention as shown in FIG. 4, the net force of reaction at the corner 12*b* is directed away from the copy paper 12, indicating less tendency to bend the corner 12*b*. Furthermore, if desired, it may be so structured that the side edge 12*c* first hits the front end 5*a* of the wall 5. This structure may be more advantageous in avoiding partial bending of the copy paper 12 depending on the material thereof.

Figure 1:
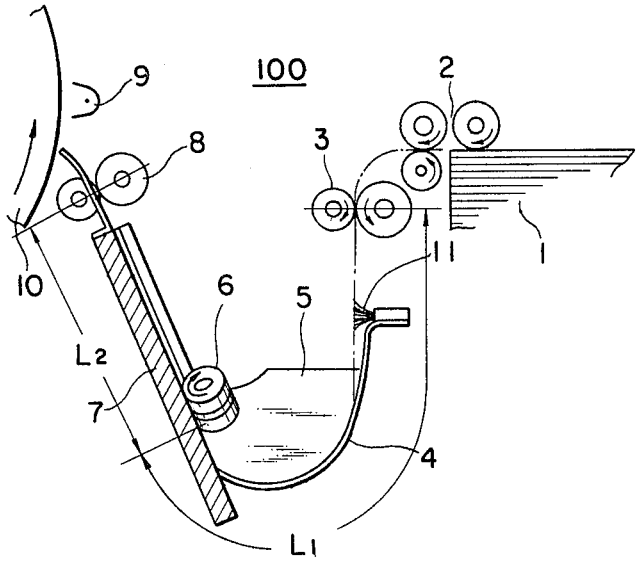
FIG. 1 PRIOR ART
FIG. 1 is a schematic front view showing one example of the conventional apparatus.
Figure 2:
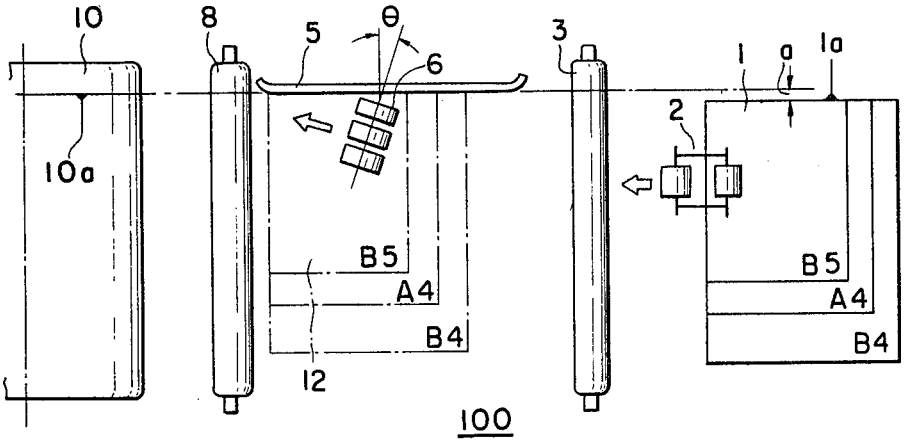
FIG. 2 PRIOR ART
FIG. 2 is an unfolded plan view of the apparatus shown in FIG. 1.
Figure 5:
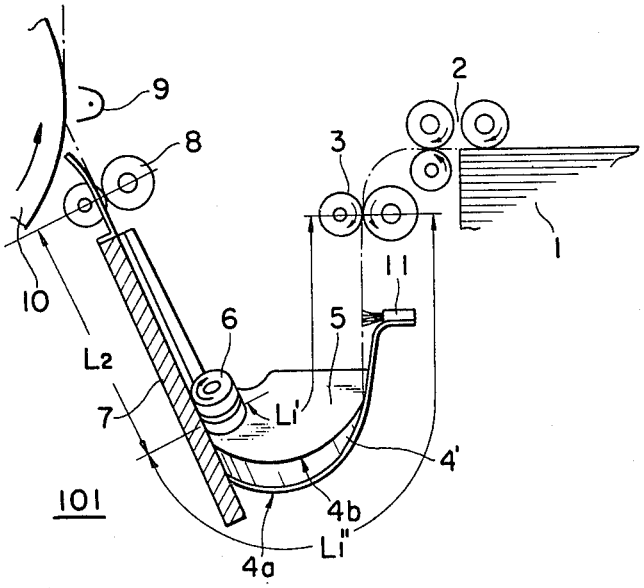
FIG. 5 is a schematic front view showing one embodiment of the present invention when applied to a copying machine.
Figure 6:
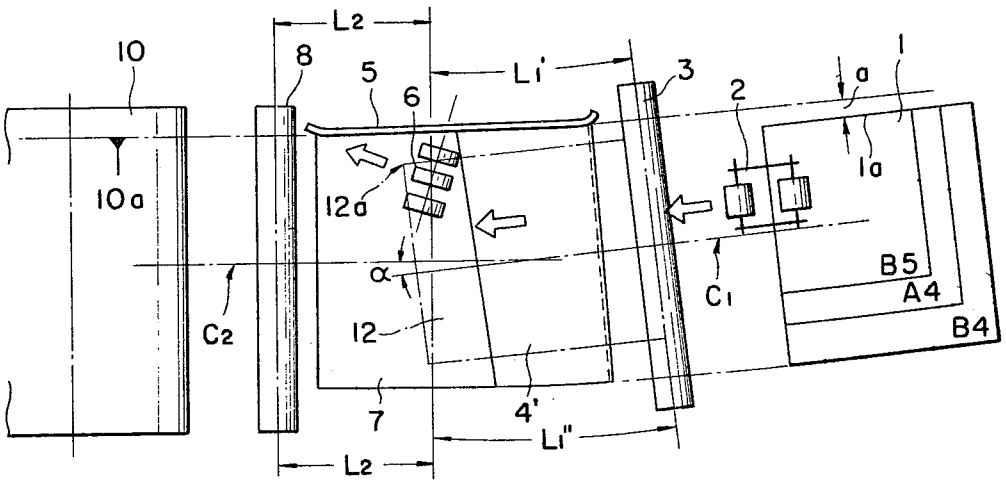
FIG. 6 is an unfolded plan view of the embodiment shown in FIG. 5.

One preferred embodiment of the present invention to carry out the aligning operation as shown in FIG. 4 is shown in FIGS. 5 and 6, in which like numerals indicate like parts as explained with respect to FIGS. 1 and 2. The copy paper transport and aligning apparatus 101 includes a curved plate 4' which has a specific shape as different from the curved plate 4 in FIG. 1. The curved plate 4 has the same cross-sectional shape across the copy paper travelling path when cut along the direction of copy paper advancement. For example, the curved plate 4 may be formed from a portion of a cylinder. Thus, the curved plate 4 and the sideline reference wall 5 make the right angle at the junction.

Meanwhile, the curved plate 4' of the present apparatus 101 has a unique shape as schematically shown in FIG. 5. The plate 4' is somewhat warped in shape; in other words, the plate 4' does not necessarily make the right angle at the junction with the wall 5, but at least a portion of the curved plate 4' is aslant with respect to the surface of the wall 5. As show in FIG. 5, the distance $L_1''$ measured along the front side 4*a* between the inclined rollers 6 and the pinch roller 3 is larger than the distance $L_1'$ measured along the back side 4*b*. Accordingly, there is formed a slope going down from the back side 4*b* to the front side 4*a*. Thus, the viewer sees a part of the top surface of the curved plate 4' in FIG. 5. As such, when the copy paper 12 is moved downward and brought into contact with the curved plate 4' by means of the pinch roller 3, the copy paper 12 tends to move toward the front side 4*a* until the copy paper 12 comes into contact with the inclined rollers 6. It should now be understood that provision of the curved plate 4' can guarantee the particular orientation of the copy paper 12 where located just in front of the inclined rollers 6 as shown in FIG. 4. If desired, a part of the curved plate 4' may be made of a portion of a truncated conical plate to satisfy the condition of $L_1'' > L_1'$. It is true that the curved plate 4' may be formed in any desired shape as long as it satisfies the abovementioned conditions, but it is preferable to construct the curved plate 4' such that copy papers 12 of different sizes may be transported along the curved plate 4' without any air gap between them.

Now, explanation will be had with respect to FIG. 6 which shows an unfolded view of the embodiment shown in FIG. 5. Since FIG. 6 is an unfolded view, all the elements are arranged on the same plane. It should be understood that since the distance $L_1''$ is larger than the distance $L_1'$, the center line $C_1$ of the copy paper advancing direction which is normal to the axis of rotation of the pinch roller 3 makes an angle $\alpha$ with the center line $C_2$ of the copy paper advancing direction which is normal to the axis of rotation of the register roller 8. The angle $\alpha$ may preferably be set between 5° and 30°, most preferably around 15°; however, it should be determined in consideration of many factors such as the material and size of copy paper used, the coefficient of friction, etc.

It can also be said that the structure shown in FIG. 6 forms another embodiment with the elements horizontally arranged. In this case, since the copy paper 12 is fed aslantly at an angle $\alpha$ with respect to the center line $C_2$, or the surface of the sideline reference wall 5, the corner 12*a* is prevented from making the first contact with the wall 5. Thus, it is only necessary to provide the supply station 1 and the pinch roller 3 in a particular angular relationship with the register roller 8 and the sideline reference wall 5, and the plates 4' and 7 may be substituted with a flat plate.

While the above provides a full and complete disclosure of the preferred embodiments of the invention, various modifications, alternate constructions and equivalents may be employed without departing from the true spirit and scope of the invention. Therefore, the above description and illustrations should not be constructed as liminting the scope of the invention, which is defined by the appended claims.

What is claimed is:

1. Apparatus for aligning a paper sheet before transporting it to a desired position comprising:

feed means for feeding said paper sheet into said apparatus along a paper sheet travelling path;

reference wall means disposed at a predetermined position with the paper sheet travelling path defined in said apparatus for aligning one side edge of said paper sheet;

roller means for bringing said paper sheet translationally in contact with said reference wall means for alignment;

orientation adjustment means for adjusting the orientation of said paper sheet with respect to said reference wall means such that said paper sheet is moved with a leading edge corner of said side edge directed away from said reference wall means until said paper sheet comes into engagement with said roller means, wherein said roller means moves said paper sheet generally translationally toward said reference wall means such that the leading edge corner of said paper sheet closer to said reference wall means is prevented from being first brought into engagement with said reference wall means; and delivering means for delivering said thus aligned paper sheet to the desired position.

2. The apparatus as defined in claim 1 wherein said roller means includes at least one inclined roller disposed at a predetermined position with respect to said reference wall means.

3. The apparatus as defined in claim 1 wherein said feed means includes a pinch roller and said delivering means includes a delivery roller.

4. The apparatus as defined in claim 1 wherein said orientation adjusting means includes a curved plate having one side contiguous to said reference wall means and at least a portion of which defines a slope going down from said one side which is contiguous to said reference wall means to the opposite side, wherein said paper sheet is directed away from said reference wall means as guided by said slope.

5. The apparatus as defined in claim 4 further comprising discharging means disposed between said feed means and said reference wall means for removing charges on said paper sheet.

6. The apparatus as defined in claim 4 wherein said orientation adjusting means further includes a flat plate connected to said curved plate in the downstream thereof.

7. Apparatus for aligning a paper sheet before transporting it to a desired position comprising:

a first plate forming a part of a paper sheet travelling path defined in said apparatus;

reference wall means disposed at one side of said flat plate and including a straight reference section;

roller means for bringing said paper sheet translationally in contact with said straight reference section of said reference wall means for alignment;

delivering means for delivering said thus aligned paper sheet to the desired position; and feed means for feeding said paper sheet onto said flat plate with a leading edge corner thereof directed away from said straight reference section of said reference wall means at a predetermined angle until said paper sheet comes into engagement with said roller means, wherein said roller means moves said paper sheet generally translationally toward said straight reference section thereby insuring that said leading edge corner of said paper sheet closer to said reference wall means is prevented from first coming into contact with said straight reference section.

8. The apparatus as defined in claim 7 wherein said angle is set between 5° and 3°.

* * * * *

UNITED STATES PATENT AND TRADEMARK OFFICE

CERTIFICATE OF CORRECTION

PATENT NO. : 4,426,073

DATED : January 17, 1984

INVENTOR(S) : KENICHI MIZUMA

It is certified that error appears in the above-identified patent and that said Letters Patent is hereby corrected as shown below:

In Claim 7, line 3 change "a first plate" to --a flat plate--.

In Claim 8, line 2 change "between 5° and 3°." to --between 5° and 30°.--.

Signed and Sealed this

*Twenty-third* Day of *October 1984*

[SEAL]

*Attest:*

GERALD J. MOSSINGHOFF

*Attesting Officer*

*Commissioner of Patents and Trademarks*